United States Patent [19]

Fellner

[11] 4,059,322

[45] Nov. 22, 1977

[54] DUST PROTECTIVE ASSEMBLY FOR BREAKAWAY CONNECTORS

[75] Inventor: Erwin J. Fellner, LaCrescenta, Calif.

[73] Assignee: Sierra Engineering Co., Sierra Madre, Calif.

[21] Appl. No.: 655,869

[22] Filed: Feb. 6, 1976

[51] Int. Cl.[2] ..... H01R 13/44

[52] U.S. Cl. ..... 339/44 R; 215/244; 220/334

[58] Field of Search ..... 220/334; 215/235, 244; 339/43–44, 251; 24/257 R

[56] References Cited

U.S. PATENT DOCUMENTS

| | | | |
|---|---|---|---|
| 57,356 | 8/1866 | Miller | 215/235 |
| 1,509,940 | 9/1924 | Elliott | 24/257 R |
| 1,937,271 | 11/1933 | Garcia | 215/235 |
| 2,304,870 | 12/1942 | Yost | 339/44 R |
| 3,189,212 | 6/1965 | Bellek | 339/44 R |
| 3,284,753 | 11/1966 | Goldbaum et al. | 339/44 R |

FOREIGN PATENT DOCUMENTS

| | | | |
|---|---|---|---|
| 1,349,337 | 12/1963 | France | 339/43 |

*Primary Examiner*—J. Howard Flint, Jr.
*Assistant Examiner*—John McQuade
*Attorney, Agent, or Firm*—D. Gordon Angus; Donald D. Mon

[57] ABSTRACT

A protective cover for an electric connector containing electric contacts within an open end of the connector comprises a peripheral clamping strip to be clamped over an elastomeric band around the peripheral wall adjacent to the open end of the connector. A base member attached to the clamping strip protrudes toward the open end where there is pivoted a protective lid which can cover the open end. A spring loads the lid so that it is urged toward the position where it closes the open end and a finger portion may be used to pivot the lid against the force of the spring to open the lid. The clamping strip has ends which overlap so that the strip is substantially in the form of a ring. The two ends of the strip are provided with louvered notches which can be drawn toward each other by a suitable tool to contact the diameter of the circle over the elastomeric band.

1 Claim, 7 Drawing Figures

DUST PROTECTIVE ASSEMBLY FOR BREAKAWAY CONNECTORS

This invention relates to a protective device for protecting an electrical type of connector against dust, sand and dirt and the like.

Electric connectors are well known. They ordinarily comprise a plug or a jack at the end of an electric conductor or cable, provided with one or more contacting elements which engage corresponding contacts of a socket or the like at an electric equipment to which the connector is to be coupled.

In the use of such equipment, it is common practice for the connector to be coupled with the electric equipment at times and to uncoupled at other times. Since the connector or jack has an open end which ordinarily leaves it contacting elements exposed when not coupled to the electric equipment it is common for the open end and the contact elements to accumulate dust, sand or dirt or the like which can interfere with satisfactory operation. Problems from sand and dust accumulation are a particular concern in environments such as a desert.

It is accordingly often desirable to provide the connector with protection from such environmental conditions. Such electrical apparatus is commonly used by personnel working under some pressure, for example, crewmen at temporary installations or in vehicles or the like. It is important that any protective device shall have a low profile to minimize the risk of entanglement with surrounding equipment or with clothing or the like. Hence, any such protective device must be simple and compact, making field installation practical and dependable even under severe conditions.

It is accordingly an object of the present invention to provide protective means for electrical contacts and other surfaces of the connector against sand, dirt, dust and the like which may be encountered when the connector is disconnected.

It is also an object of the invention to provide such a protective device having a low profile, free from risk of entanglement with surrounding equipment and clothing or the like.

The invention is carried out by provision of a clamping strip which encircles the open end of the connector or jack and a pivotal lid attached to the clamp and positioned at the open end of the connector so that it can pivot to a position at which it covers the open end. Biasing or loading means, preferably a spring, urges the lid to pivot in the direction which causes it to close the open end.

In accordance with a preferred feature a base member is attached to the clamp to support a pivot means for the lid.

According to another preferred feature, the pivotal lid is provided with a finger member for pivoting the lid in the direction which opens the lid from the open end of the connector against the pressure of the loading means.

The clamping strip is provided with means for contracting it tightly against an outer peripheral surface of the connector. Preferably, an elastomatic band is placed between the last-mentioned peripheral surface and the inner surface of the clamping strip. The means for tightening the clamping strip preferably comprises louver notches near both ends of the clamping strip which can be engaged by a tool having fingers which grip against a notch at each end portion of the clamp where the ends overlap, to urge the ends toward a more overlapping position at which a hook near one end of the strip engages a notch near the other end of the strip.

Another preferred feature resides in the provision of a keying member at the open end of the connector to register with a notch of the lid for insuring a position of optimum angularity of the dust cover relative to the connector.

The dust cover according to this invention is simple, compact and east to install without any modification to the existing connectors, and has a minimum of protruding parts.

The foregoing and other advantages and features of the invention will be better understood from the following detailed description and the accompanying drawing of which:

Figure 1:
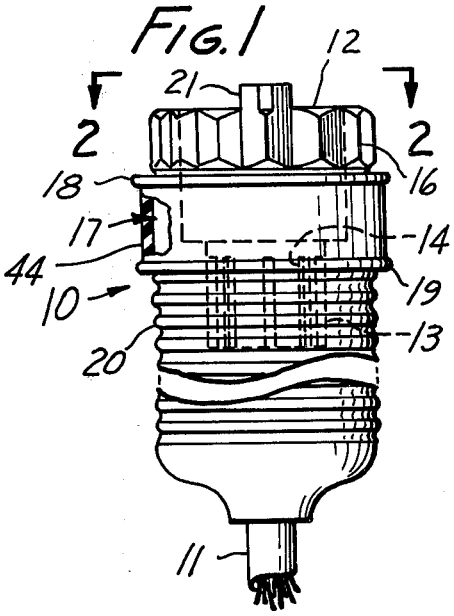
FIG. 1 is an elevation view of a typical electrical socket connector.
Figure 2:
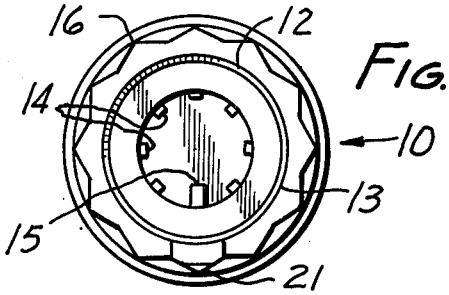
FIG. 2 is an end view looking from line 2—2 of FIG. 1.

Referring to the drawing, FIGS. 1 and 2 show a socket connector 10 into which there is brought an electric conductor or cable 11 containing conductors. The end 12 of the connector opposite that of the introduction of cable 11 is open, and within this open end there is at least one usually more than one, electric contact element attached to a respective conductor or conductors within cable 11, according to a common practice. There is fixed within the open end a hollow cylindrical member 13 of insulating material to the inner cylindrical circumference of which there are fixed a number of spaced electrical contact elements 14 which are connections which are not shown. The arrangement of the contact elements and their connections to the cable are in accordance with a well known practice and need no further discussion here.

A key number 15 integral with cylinder 13 is provided for entry into a corresponding keyway of an electric equipment containing contacts, so that the contact elements 14 will meet with the corresponding proper contacts of the equipment, according to common practice. At the open end 12 the socket connector is fluted at 16 around its outer circumference for added strength and improved wearing qualities. Beneath the fluted area 16 there is provided a smooth cylindrical outer surface 17.

The outer cylindrical surface of the body of the socket connector below ring 19 is provided with circular ribs 20 to facilitate grasping the jack for application and removal to the electrical equipment with which it is to be connected. At one angular position at the extreme outer end of the fluted portion 16 there is provided a keying tab 21 for alignment with the dust protector assembly as will be explained hereinafter.

Figure 6:
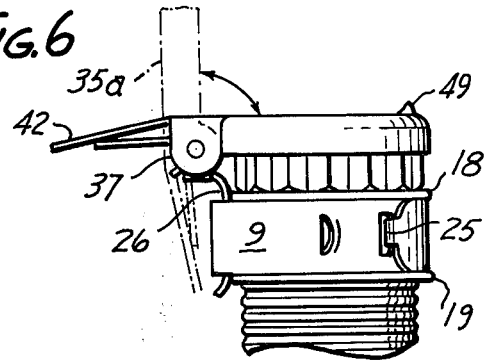
FIG. 6 is an elevation view showing the dust cover of FIG. 3 attached to the open portion of the connector.
Figure 7:
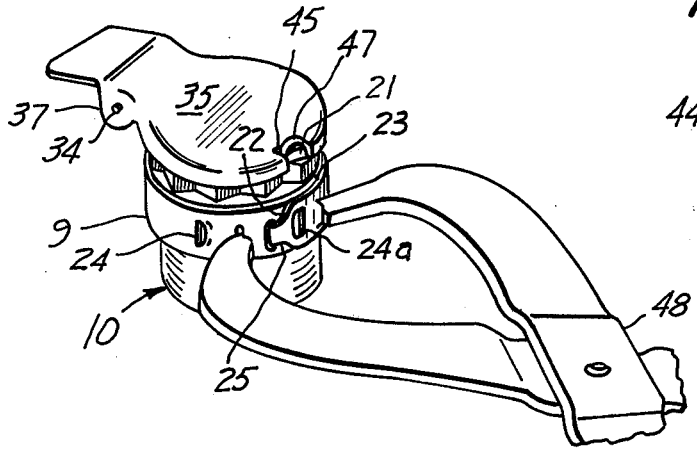
FIG. 7 is a perspective view illustrating the clamping of the dust cover to the connector end.

The dust cover arrangement comprises a circular clamping means 9 as shown in FIGS. 3, 4, 6 and 7. This comprises a bendable strip, ordinarily of metal, which assumes a normal substantially circular position with its two ends 22 and 23 overlapped as is best seen in FIG. 7. The region adjacent end 23 is provided with a number of spaced louver notches 24 which are openings through the strip. Near the other end 22 of the strip area are provided additional spaced louver notches 24a, and the end 22 is formed into a hook 25 which can be hooked into one of the louver notches 24 near end 23.

At a position of clamp strip 9, there is attached to the strip a base member 26, which may be done for example by welding at leg portions 27 and 28 which lie against the inner surface of the strip 9. At a position above the strip 9 the base member 26 is curved in the direction away from the central axis of strip 26, at a position 29. From the flat horizontal portion 29 there are carried upwardly from opposite sides of portion 29, two arms 30 and 31 which are juxtaposed and spaced from each other. These arms have opposed holes 32 and 33 passing through them and through these holes there is passed a pin 34.

A lid 35 provided with depending ears 36 and 37 is positioned so that the respective ears lie just outside of respective arms 30 and 31. Holes 38 and 39 are formed through these depending ears at positions which register with holes 32 and 33 of the arms so that the pin 34 passes through holes 38 and 39 so that the lid may pivot at the pin relative to the upstanding arms of the base member. The pin may be held in position by any suitable means such as by upsetting its protruding ends or by fixing one end to one of the depending ears of the lid.

Figure 3:
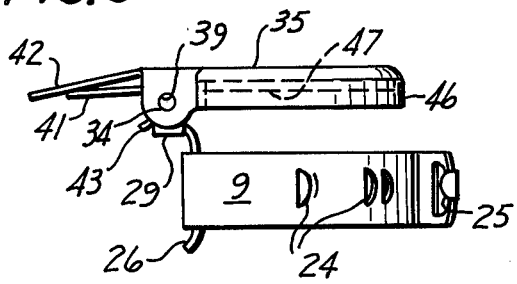
FIG. 3 is an elevation view of a dust cover according to this invention adapted to cover the open end of the connector shown in FIGS. 1 and 2.
Figure 4:
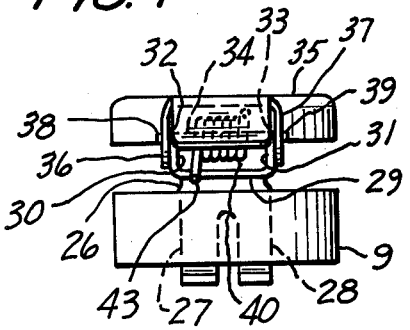
FIG. 4 is a view of the dust cover of FIG. 3 viewed at an angle of 90° from the view shown in FIG. 3.

A spring 40 urges the lid 35 to rotate at the pivot pin in the clockwise direction relative to FIGS. 3 and 6. This spring is a helical spring one end 41 of which protrudes rearwardly for some distance to contact the under side of a finger portion 42 which extends rearwardly from the lid and somewhat downwardly relative to the horizontal position of the lid shown in FIGS. 3 and 6. The other end 43 of the spring bears against the rear edge of horizontal portion 29 of the base member 26 as seen in FIGS. 3 and 4. The spring having its two ends restrained in this manner is spring-biased to produce the tendency for the lid to rotate as explained above. It is seen that the lid can be rotated in the counterclockwise direction against the loading of the spring by pressing down on finger portion 42 of the lid while the clamp is restrained from movement.

Figure 5:
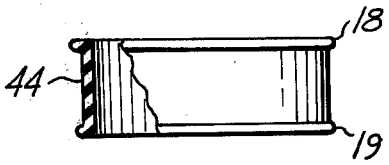
FIG. 5 illustrates an elastomeric band which is to be placed around the connector show in FIG. 1, in preparation for attaching the dust cover.

As an aid in securing the clamp to the connector there is preferably applied around the peripheral surface 17 of the connector a band 44 of elastomeric material such as a rubber or rubber-like material having circumferential raised circular rings 18 and 19 at its edges, as shown in FIG. 5. This elastomeric band 44 is placed tightly around the smooth region 17 of the connector as shown in FIG. 1.

After placement of the band in this manner, the clamp strip 9 is brought down over the connector end and around the band 44 between rings 18 and 19 as illustrated in FIGS. 6 and 7. It may be desired that the dust cover shall have a particular angularity with reference to the connector. This particular angularity is established by the placement of notch 45 in the depending peripheral rim 46 depending from the top surface of the lid. This notch is carried inward from the periphery toward the center of the lid for some distance thereby exposing a portion of a circular gasket 47 adherent to the under flat surface of the lid.

In applying the clamp to the connector the keying tab 21 is caused to register with the notch 45. Then by use of a suitable tool such as pliers 48 shown in FIG. 7, one of the fingers of the pliers is registered with a louver notch adjacent one end of the clamp strip while the other finger of the pliers is registered in a louver notch near the other end of the strip. Thus by forcing the plier fingers toward each other the clamp strip is compressed against the elastomatic band to a suitable degree of compression and the hook 25 is caused to be inserted in a corresponding louver notch at the opposite end of the strip as illustrated in FIG. 7. In this position the clamp strip forms a circular clamp around the elastomatic band such that the cover device is firmly attached to the jack.

The elastomeric detaining band or ring provides an important non-slip feature for the protective cover assembly; it protects the surface of the connector from the surrounding clamps; it provides fairing between the clamp and the connector; and it acts as a compressive medium between the clamp and connector body.

In the protective position shown in FIGS. 6 and 7 the keying tab protrudes upwardly through the cover notch 45 far enough so that it bulges the portion of the cover gasket upwardly at the region of this notch to a position 49 best seen in FIG. 6. In this position the lid 35 is flat against the open end 12 of the jack and the cover rim 46 envelopes the outer ends of flutes 16. In this position, with the aid of the gasket the cover protects the open end of the connector from dust and dirt. The presence of the keying tab and corresponding cover notch is not essential, but they have the advantage of preventing rotational slip of the cover, and are usually desirable.

When it is desired to attach the socket connector to an electrical equipment, the pressure from the thumb or finger against finger portion 42 while the operator is holding the connector, will pivot the cover counterclockwise to a position indicated by broken lines 35a in FIG. 6 in which position the connector may be engaged to the electrical equipment in the usual manner.

It will be recognized that by this invention there is provided a protective cover assembly which is compact and has simplicity of design. The spring-loaded lid will automatically seal the socket connector mating areas from sand and dirt and the like as soon as the plug is withdrawn from the socket connector with which it is connected. The protective cover assembly may be fastened without modification to an existing connector in approximately one minute even by unskilled personnel, which in itself is a unique advantage. It has the further advantage of the capability of retrofitting existing units in the field, and the period for which equipment is out of operation during installation is negligible.

This invention is not to be limited by the embodiments shown in the drawings and described in the description, which are given by way of example and not of limitation, but only in accordance with the scope of the appended claims.

I claim:

1. In combination: an electrical connector of the type having a hollow cylindrical peripheral wall terminating at an open end and containing electric contact means within said wall near said open end, adapted to engage mating contact means of an electric equipment; and a cover at said open end; said cover comprising:

a cylindrical band of elastomeric material around the peripheral wall adjacent said end;

a clamp comprising a cylindrical strip compressed around the exterior surface of said elastomeric band, a string-loaded lid; and means pivotally attaching the lid to the clamp;

said lid having a notch at an angular position remote from said means pivotally attaching the lid to the clamp, which registers with a keying tab protruding from the open end of the peripheral wall;

said lid being positioned so that it is held by the spring against said open end when the contact means of the connector is not engaged with any mating contact means, thereby preventing dust and dirt from entering said open end, but permitting said connector contact means to be engaged with such mating contact means by pivoting the lid against the force of the spring sufficient to uncover said open end.

* * * * *